US007690277B2

(12) United States Patent
Kellermann et al.

(10) Patent No.: US 7,690,277 B2
(45) **Date of Patent: *Apr. 6, 2010**

(54) STARTER DEVICE FOR AN ENGINE UNIT WITH IMPROVED DAMPING

(75) Inventors: Christian Kellermann, Stapelfeld (DE); Klemens Krahn, Norderstedt (DE)

(73) Assignee: Dolmar GmbH, Hamburg (DE)

( * ) Notice: Subject to any disclaimer, the term of this patent is extended or adjusted under 35 U.S.C. 154(b) by 21 days.

This patent is subject to a terminal disclaimer.

(21) Appl. No.: 12/114,976

(22) Filed: May 5, 2008

(65) Prior Publication Data

US 2008/0276733 A1 Nov. 13, 2008

(30) Foreign Application Priority Data

May 8, 2007 (DE) ..... 20 2007 006 551
Oct. 5, 2007 (DE) ..... 20 2007 013 982

(51) Int. Cl.
*F02N 1/00* (2006.01)

(52) U.S. Cl. ..... 74/7 C; 74/7 D; 123/179.25; 464/87

(58) Field of Classification Search ..... 74/6, 74/7 C, 7 D; 123/179.25, 179, 24; 192/42; 464/87

See application file for complete search history.

(56) References Cited

U.S. PATENT DOCUMENTS

| | | | | |
|---|---|---|---|---|
| 2,942,599 | A | 6/1960 | Irgens | |
| 3,814,073 | A | 6/1974 | Nakatani | |
| 5,111,707 | A | 5/1992 | Sugiyama | |
| 5,287,832 | A * | 2/1994 | Uhl | 123/185.3 |
| 6,374,791 | B1 * | 4/2002 | Kuwabara et al. | 123/179.25 |
| 6,802,779 | B2 * | 10/2004 | Tabuchi et al. | 464/32 |
| 6,971,359 | B2 | 12/2005 | Tohyama | |
| 2002/0052242 | A1 * | 5/2002 | Tabuchi et al. | 464/87 |

FOREIGN PATENT DOCUMENTS

| | | |
|---|---|---|
| DE | 1 476 540 | 8/1970 |
| DE | 41 350 405 A1 | 4/1993 |
| DE | 102 55 838 | 6/2004 |
| DE | 603 04 245 T2 | 12/2006 |
| EP | 1 203 883 A2 | 8/2002 |
| GB | 1145906 * | 3/1969 |

* cited by examiner

*Primary Examiner*—David M Fenstermacher
(74) *Attorney, Agent, or Firm*—Kelly Lowry & Kelley, LLP

(57) ABSTRACT

A device for starting an internal combustion engine for hand-held tools, chainsaws, lawnmowers, trimmers and the like, includes a rotatable pulling medium roller which can be brought into functional connection with the crankshaft of the internal combustion engine in order to bring about a rotation of the crankshaft. The starting device has a simply configured functional connection between the crankshaft and the pulling medium roller and effectively reduces the force peaks reaching the pulling medium roller. To accomplish this, a deformation body having elastic deformation behaviour is arranged in the functional connection between the pulling medium roller and the crankshaft. The deformation body compensates for leading or lagging of the crankshaft with respect to the pulling medium roller.

13 Claims, 3 Drawing Sheets

STARTER DEVICE FOR AN ENGINE UNIT WITH IMPROVED DAMPING

TECHNICAL FIELD

Figure 1:
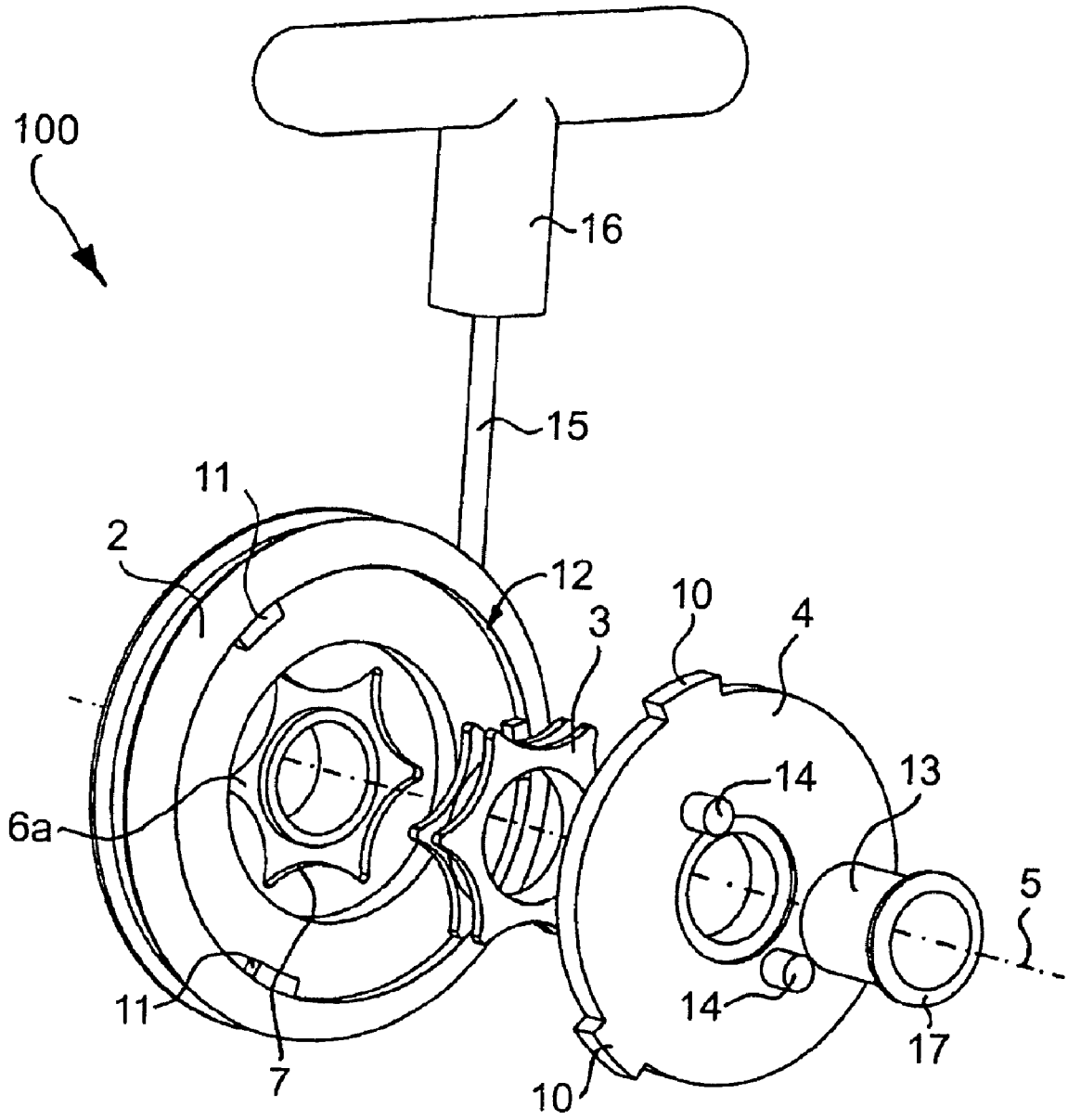

The present invention relates to a starter device for starting an internal combustion engine, in particular for manually operated engine units for driving garden and park care equipment such as chainsaws or lawnmowers, or for mopeds, boat engines and the like. Starter devices of the present invention include a rotatable pulling medium roller, which can be brought into functional connection with the crankshaft of the internal combustion engine in order to bring about a rotation of the crankshaft.

BACKGROUND OF THE INVENTION

Starter devices of the type concerned here are mostly configured with a handle in order to start the internal combustion engine manually. The handle comprises a grip, which is connected with a pulling element such as a cord or a flat band, with the cord or flat band being wound around the pulling medium roller. When the user exerts a pulling force on the pulling medium, the pulling medium roller is set in rotation.

The rotation is transferred to the crankshaft of the internal combustion engine by means of a functional connection with the crankshaft in such a manner that the internal combustion engine can start. In addition to manual actuation of the starter devices, electric motors are known, which set a drive element in rotation, which is in functional connection with the crankshaft. Furthermore, other mechanical, hydraulic or pneumatic starter devices are known, which however all function according to the same basic principle. Consequently, the kick starter for mopeds can likewise be designated a starter device to which the present invention applies.

Owing to the construction of the internal combustion engine, the rotation of the crankshaft has a torque profile which varies periodically. During the compression phase of the internal combustion engine cycle, a high torque is required, which must be passed to the crankshaft in order to set the internal combustion engine in rotation.

During the expansion phase, the crankshaft in contrast only requires a low torque or no torque at all, since the expansion of the gas in the combustion chamber of the internal combustion engine produces the effect of a gas spring so that the crankshaft rotates automatically. This highly periodic torque requirement of the internal combustion engine to be started produces in the pull cord a correspondingly periodic rising and falling force requirement, which the user must apply. The user senses this periodic rising and falling force requirement as a jerky, pulsing load.

Force peaks can be avoided with a variokinematic connection or mechanism between the cord roller and the crankshaft, as is disclosed in the earlier filed application DE 20 2007 006 551.5. The damping effect is however rather small, since there is no appreciable flexibility in the functional connection. The effect of the different phase positions between the crankshaft and the pulling medium roller can however be compensated by using variokinematic connections.

In order to damp the force peaks which reach the pulling medium roller via the crankshaft, torsion spring devices are likewise known, which are arranged between the pulling medium roller and a driver. The rotation brought about by means of the pulling medium and the pulling medium roller is passed via the torsion spring device so that the torsion spring device makes possible a compensation of the rotation for the compression phases of the internal combustion engine which causes the engine shaft to lead. The force peaks in the cord pull, which would otherwise arise as a result of two components with opposed acceleration vectors meeting each other are thereby effectively suppressed. The torque required for starting is transferred in a form-fitting manner via large-area stops positioned on the outside of the torsion spring. The disadvantage here arises in the case of pulling medium rollers consisting of a plastic material having a tendency to wear as a result of the high surface pressures from the torsion spring element.

DESCRIPTION OF THE INVENTION

Object, Solution, Advantages

It is therefore the object of the present invention to create a starter device which has a simply configured functional connection between the crankshaft and the pulling medium roller and effectively reduces the force peaks reaching the pulling medium roller.

This object is achieved starting from a starter device having a deformation body in the connection between the pulling medium roller and the crankshaft. Advantageous developments of the invention are specified in the dependent claims.

The invention includes the technical teaching that a deformation body with an elastic deformation behaviour is arranged in the functional connection between the pulling medium roller and the crankshaft, in which deformation body a leading or lagging of the crankshaft with respect to the pulling medium roller can be compensated.

The advantage of integrating a deformation body in the functional connection between the pulling medium roller and the crankshaft, lies in the simple configuration of the damping element without the use of an expensive torsion spring being necessary. When the force or moment flows from the pulling medium roller to the crankshaft, a compression arises in the deformation body, with the compression being released again when the crankshaft leads the pulling medium roller. This is brought about by storing kinetic energy in the material of the deformation body. The consequence is that the force profile which pulses over the crank angle does not act to its full extent on the pulling medium roller, since part of the stored energy is absorbed in the deformation body. The deformation body is advantageously formed from a rubber material or a rubber-like plastic material, a polyurethane, a foamed material or the like with permanently elastic properties. The material of the deformation body has a high absorption capacity so that a damping of the movement between the pulling medium roller and the crankshaft can be achieved in a targeted manner. A high level of damping is produced by the absorption effect so that the crankshaft, the pulling medium roller and the deformation body arranged between them do not form a system which can oscillate. A simple, cost-effective and robust construction can be produced according to the invention, in which no high surface pressures arise, as are observed when applying stops or spring hooks of the torsion spring to the pulling medium roller and which can cause damage in the case of a plastic configuration.

According to a further advantageous embodiment of the starter device, a drive plate is arranged in the functional connection between the pulling medium roller and the crankshaft. The drive plate is connected to the pulling medium roller in a rotationally fixed manner and is aligned in a plane-parallel with respect to the pulling medium roller. The deformation body is arranged between the pulling medium roller and the drive plate in order to create a rotationally elastic connection between the pulling medium roller and the drive plate. The pulling medium roller, the drive plate and the deformation body arranged between are arranged rotationally symmetrically about a common axis of rotation, which extends through the starter device in a common axis of symmetry.

The drive plate forms a type of intermediate element which bounds the deformation body in order to form a receptacle for the latter. To this end, both the pulling medium roller and the drive plate have a recess formed in each case on the hub side, into which recess the deformation body extends. The arrangement of the deformation body in the respective recesses can be configured symmetrically, with it also being possible for the deformation body to be accommodated predominantly on one side either in the hub of the pulling medium roller or in the hub of the drive plate. A recess is provided according to the invention on the hub side so that the moments acting on the deformation body effectively produce a greater deformation than if the deformation body has a greater diameter and is arranged in a ring shape between the pulling medium roller and the drive plate. The moments acting on the deformation body produce greater deformations owing to the small diameter of the deformation body compared to the diameter of the pulling medium roller, so that an improved compensation of the leading and lagging of the crankshaft relative to the pulling medium roller can be achieved.

In order to create a form-fitting connection between the pulling medium roller, the drive plate and the deformation body, the latter has a star-shaped outer contour. Both the recess in the pulling medium roller and the recess in the drive plate are configured to match this star-shaped outer contour with a star-shaped contour, into which the contour of the deformation body can fit. The star-shaped outer contour can comprise five star points, with a multiple wedge structure in a shape similar to a gear also being possible, in order to ensure the necessary form fit to transfer the torque. The outer contour of the deformation body can consequently also be limited to a cam structure, with the deformation body as a whole having a round cross section. The cams can engage in corresponding recesses in the pulling medium roller or the driver in order to achieve a form fit in the same manner. Furthermore, the possibility also exists of configuring the deformation body as a triangular, rectangular, or pentagonal structure or the like, with it being possible to select an optimized form fit geometry, in particular with respect to manufacturing considerations.

According to an advantageous development of the deformation body according to the invention, the latter can comprise a body which is advantageous for facilitating the deformation. A body form which facilitates deformation can consist of a deformation body which is divided in the direction of the axis of rotation into a cylindrical section and two end sections. One end section is aligned in the direction of the pulling medium roller and the other end section is aligned in the direction of the drive plate. Each end section has the form fit geometry, which for example consists in the star-shaped outer contour. The cylindrical section is arranged between the end sections, with the respective sections merging integrally and in one material. If a torque is then passed to the pulling medium roller, it is then transferred to the end section on the pulling medium roller side. This leads to a torsion of the deformation body relative to the end section on the drive plate side. The main portion of the twisting of the drive plate relative to the pulling medium roller can consequently be produced in the cylindrical section of the deformation body, with the twisting resistance being dependent not only on the rubber mixture but also on the cross-sectional area of the deformation body in the direction of the axis of rotation and adjustable by such qualities. The deformation can also take place in the respective end sections, with this being smaller than in the cylindrical section.

As a further development of the arrangement according to the present invention, the deformation body and the drive plate comprise at least one stop cam in the drive plate. At maximum twisting, the stop cam comes to bear against a stop geometry formed on the pulling medium roller in order to limit the twisting movement of the drive plate with respect to the pulling medium roller. The advantage of this construction arises in that the deformation body cannot be overextended, since the stop cam comes to bear on the stop geometry before the deformation body is damaged. A plurality of stop cams and stop geometries are preferably provided, with the number of stop cams corresponding to the number of stop geometries. The stop cam together with the stop geometry forms a stop pairing, with preferably two to four and particularly preferably three stop pairings being arranged between the pulling medium roller and the drive plate in order to allow a uniform transfer of force without transverse forces arising. The arrangement of three stop pairings has the advantage that the twisting of the drive plate with respect to the pulling medium roller can find a corresponding stop both in a first direction and in an opposed second direction. Consequently, there are in the case of three stop pairings approximately 60 degrees between the respective maximum stops for twisting so that the neutral arrangement of the stop cam is aligned in the bisector between two stop geometries. Consequently approximately 60 degrees are possible both in one twisting direction and in the other twisting direction.

The pulling medium roller is advantageously configured with an accommodating depression in which the drive plate can be inserted. The outer diameter of the drive plate is therefore matched to the inner diameter of the accommodating depression in the pulling medium roller. The depth of the accommodating depression in the direction of the axis of rotation also corresponds approximately to the thickness of the drive plate so that a compact unit can be formed from the pulling medium roller, the deformation body arranged in between and the drive plate when they are joined together. This further produces an advantageous arrangement of the stop pairing so that the drive plate can have a plurality of stop cams which are arranged on the outside on the outer diameter. The pulling medium roller can further have a plurality of stop geometries which are placed on the inner diameter of the accommodating depression and extend radially inwards. An interaction between the stop geometries and the stop cams is thus made possible without having to create additional installation space for it.

According to a further development of the design of the starter device, an axis element is provided, which extends along the axis of rotation through the drive plate, the deformation body and the pulling medium roller. The axis element can be used for accommodating the pulling medium roller, the deformation body and the drive plate, with it being further possible for the axis element to have a collar at the end in order to guide the components axially with respect to the axis of rotation. The inner diameter of the drive plate can be adapted in such a manner that the drive plate forms a sliding bearing with the outer diameter of the axis element. The same can be made possible with a correspondingly configured hub of the pulling medium roller.

The drive plate can have two drive pins on the flat surface which lies opposite the star-shaped recess. A pawl system is connected to the drive pins in order to create a free-running state in the internal combustion engine. This pawl system, which is also referred to as a locking mechanism, permits a drive moment to be transferred to the crankshaft of the internal combustion engine as long as the engine has not started yet. As soon as the internal combustion engine runs by itself, the rotation of the crankshaft overtakes the rotation of the starter device. This releases two pawls, which can be placed rotatably on the drive pins. The locking mechanism can consequently bind the drive plate and is subsequently connected to the crankshaft or the engine flange.

According to the invention, both the pulling medium roller and the drive plate can be fabricated from a plastic material, with preferably a polycarbonate or a comparable plastic appearing particularly suitable. The possibility also exists, however, of fabricating the pulling medium roller and the drive plate from die cast aluminium, so that only the hub has to be subsequently machined.

The present invention can further be combined with the disclosure content of the earlier application DE 20 2007 006 551.5 in that the variokinematic functional connection between the driven element and the crankshaft proposed therein can be connected to the functional connection between the pulling medium roller and the crankshaft proposed in the present invention so that a variable gear or reduction ratio is created as a function of the crankshaft rotation angle and a deformation body is additionally included in the functional connection. The additional use of the deformation body in the variokinematic gear mechanism or the variokinematic connection allows any force peaks during the starting process to be effectively damped. The deformation body can itself be arranged in front of or behind the variokinematic gear mechanism. It is optionally conceivable to replace an element of the variokinematic gear mechanism with a comparable deformation body.

Reference is hereby explicitly made to the piston rod 6 or the flexurally elastic coupling member 21 from the earlier application DE 20 2007 006 551.5.

The present invention further relates to a method for fabricating a starter device with a deformation body, wherein the deformation body is injected into the star-shaped hollow space between the pulling medium roller and the drive plate by means of an injection moulding method. The star-shaped hollow space arises as a result of the drive plate being inserted in the accommodating depression provided for the purpose. As soon as the drive plate and the pulling medium roller are joined together, the star-shaped hollow space is produced in which the deformation body can be fitted. An injection moulding method consequently lends itself, in which the material of the deformation body is injected on the hub side into the star-shaped hollow space preferably via an annular gate. The material of the deformation body can particularly preferably be vulcanized on the surfaces of the pulling medium roller and/or the drive plate. A permanent connection between the deformation body and the pulling medium roller or also the drive plate is thereby created.

SHORT DESCRIPTION OF THE DRAWINGS

Figure 2:
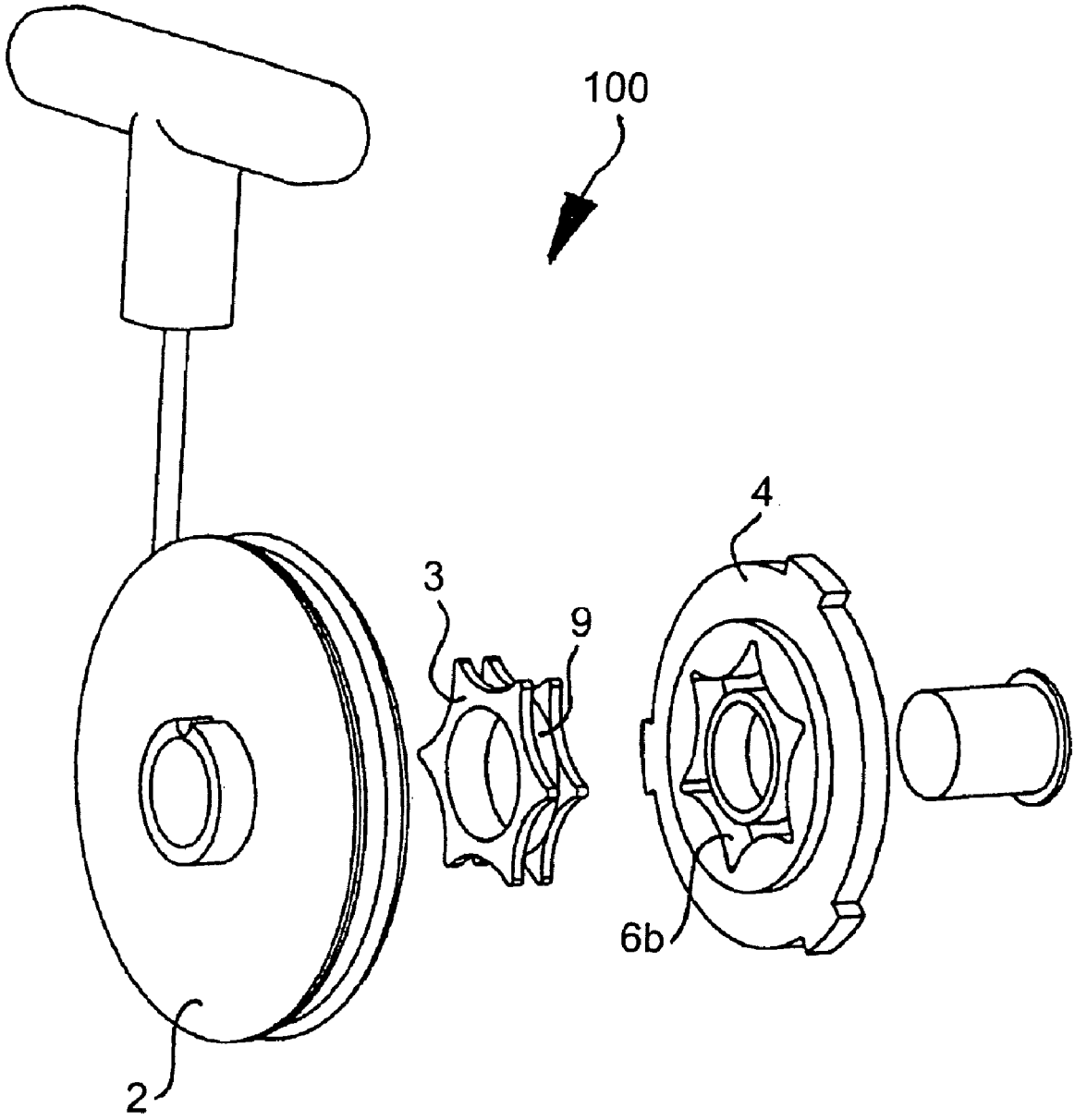
Figure 3:
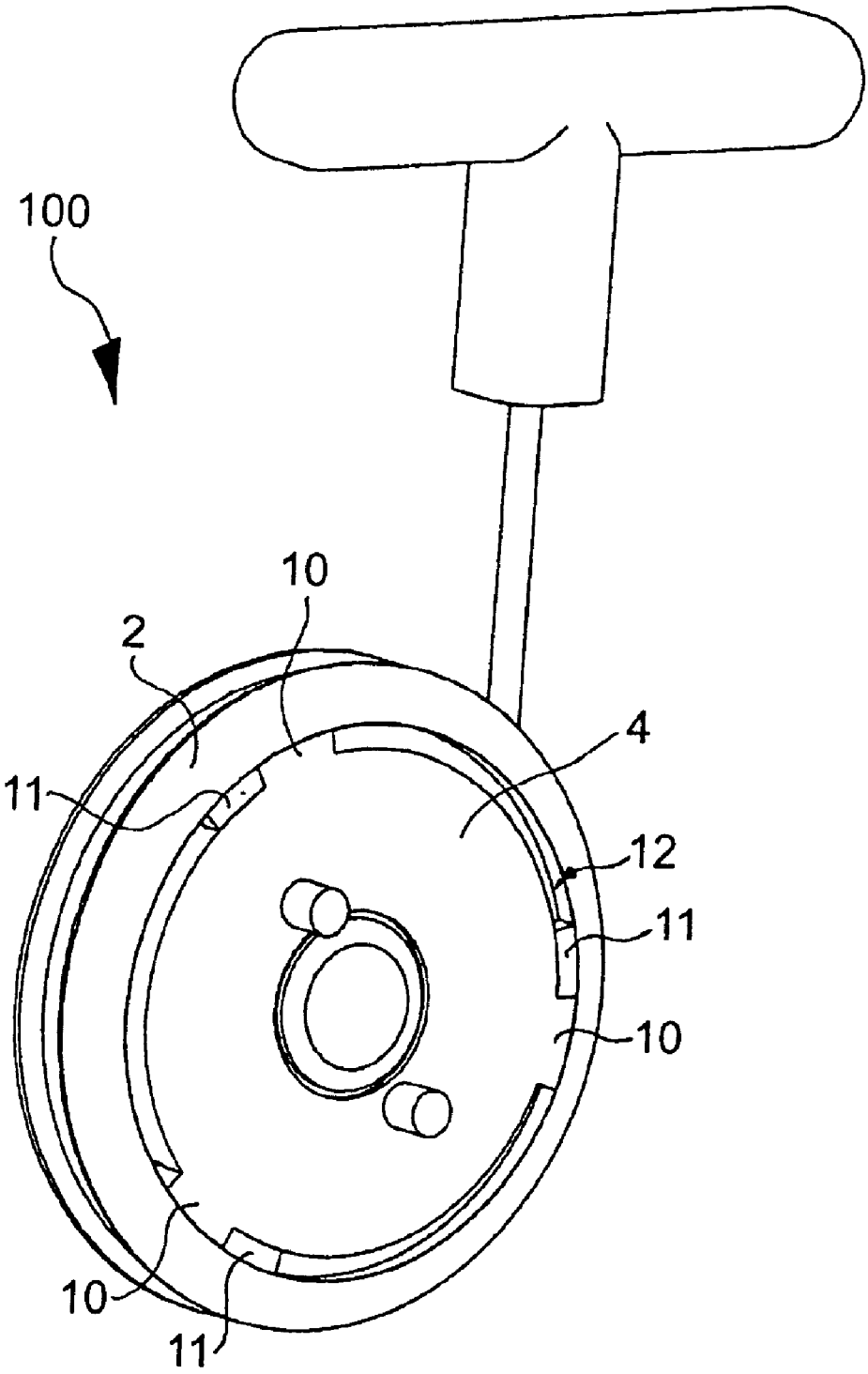

Further measures which improve the invention are presented in more detail below together with the description of a preferred exemplary embodiment of the invention, with the aid of the figures. In the figures, in a purely schematic representation:

FIG. 1 shows a first view of a starter device with a deformation body, which is arranged between a pulling medium roller and a drive plate, FIG. 2 shows a second view of the starter device according to FIG. 1 and FIG. 3 shows the starter device according to FIGS. 1 and 2 in an assembled state.

BEST WAY OF CARRYING OUT THE INVENTION

FIG. 1 shows an exemplary embodiment of a starter device 1 according to the present invention. This has a pulling medium roller 2, around which a pulling medium 15 is bound. The pulling medium 15 can be configured as a cord or a band and comprises a handle 16 at the end in order that a user can exert a force on the pulling medium 15 manually. The pulling medium roller 2 is consequently set in rotation so that it rotates around the axis of rotation 5.

A drive plate 4 is arranged in a plane-parallel to the pulling medium roller 2, with the deformation body 3 according to the invention being inserted between the pulling medium roller 2 and the drive plate 4. The illustration shows the starter device 1 in a non-assembled state so that it can be seen that the deformation body 3 can fit in a recess **6*a*, which is located in the hub region in the pulling medium roller 2. Both the deformation body 3 and the recess 6*a* have an outer contour 7, which is configured like a star with five points. A form-fitting contact between the deformation body 3 and the pulling medium roller 2 can thereby be produced in order to transfer a torque. The pulling medium roller 2 comprises on its flat side an accommodating depression 12 in which the drive plate 4 can be inserted. The depth of the accommodating depression 12 corresponds approximately to the thickness of the drive plate 4**.

The outer diameter of the drive plate 4 corresponds approximately to the inner diameter of the accommodating depression 12, with three stop cams 10 being formed on the outer diameter of the drive plate 4. At maximum twisting, each stop cam 10 comes to bear against three stop geometries 11 which are formed on the pulling medium roller 2 in order to limit the twisting movement of the drive plate 4 with respect to the pulling medium roller 2. Owing to the three stop pairings provided, consisting of the stop cams 10 and the stop geometries 11, the twisting travel of the drive plate 4 in the pulling medium roller 2 can be limited in order to prevent an overload of the deformation body 3.

The starter device 1 according to the invention further comprises an axis element 13 which extends along the axis of rotation 5 and by means of which both the pulling medium roller 2 and the drive plate 4 can be accommodated. The axis element 13 comprises a cylindrical section with a collar 17 at the end and interacts with the hub of the drive plate 4 or also with the hub of the pulling medium roller 2 in order to form a sliding bearing arrangement. The arrangement of the starter device 1 can be fixed to the housing of the engine unit by means of a screw-fastening element (not shown), which can extend through the axis element 13. On the side of the drive plate 4 which is situated opposite the pulling medium roller 2, two drive pins 14 are formed in order to accommodate a pawl system by means of which a free-running state with respect to the engine shaft of the engine unit can be created. The drive plate 4 is consequently configured as a multifunctional component and forms an effective connection between the deformation body 3 and the subsequently arranged free-running state.

FIG. 2 shows a further perspective view of the starter device 1 in a non-assembled view. The drive plate 4 likewise has a recess **6*b*, in which half of the deformation body 3 can be inserted. Half the deformation body 3 consequently extends into the recess 6*a* in the pulling medium roller 2 (see FIG. 1) and half extends into the recess 6*b* in the drive plate 4**.

According to an advantageous form of the deformation body 3, it has both a first end section and a second end section, between which a cylindrical section 9 extends. The respective end sections likewise comprise a star-shaped outer contour, which corresponds with the star-shaped recess 6*a*, 6*b* in the pulling medium roller 2 and in the drive plate 4 in such a manner that it fits precisely. If the first end section is twisted relative to the second end section of the deformation body 3, then the elastic twisting within the deformation body 3 can take place in the cylindrical section 9.

FIG. 3 shows a perspective view of the starter device 1 in an assembled state. The drive plate 4 is inserted into the accommodating depression 12 in the pulling medium roller 2. Here it becomes clear how the stop cams 10 which are formed on the drive plate 4 interact with the stop geometry 11 which is introduced in the inner region of the accommodating depression 12 in the pulling medium roller 2.

According to the illustration, the stop cams 10 bear against the stop geometries 11. The configuration according to the invention of the starter device 1 allows a compact construction of a pulling medium roller 2 with integrated compensation of the different rotation speeds between the engine shaft and the pulling medium roller 2 in that the drive plate 4 can be inserted in an accommodating depression 12 in the pulling medium roller 2. The installation space required for the pulling medium roller 2 with the function according to the invention of damped transfer of torque to a drive plate 4 is no greater than that required for a conventional configuration of a pulling medium roller 2. Consequently the advantage is produced that existing systems can be updated with the starter device 1 according to the invention, with only the pulling medium roller 2 needing to be replaced correspondingly.

The configuration of the invention is not restricted to the above-described preferred exemplary embodiment. Rather, a number of variants are conceivable which make use of the presented solution even in fundamentally different embodiments.

The invention claimed is:

1. A starting device for an internal combustion engine for hand-held tools, chainsaws, lawnmowers, trimmers, comprising:

a rotatable pulling medium roller connected to a drive plate on a crankshaft of the internal combustion engine for initiating a rotational movement in the drive plate and crankshaft;

a deformation body formed as a rubber elastic body extending between the pulling medium roller and the drive plate thereby making the connection between the pulling medium roller and the drive plate rotational and elastic, wherein the pulling medium roller, the drive plate and the deformation body share a common axis of rotation and the deformation body has a star-shaped outer contour; and a first recess in the pulling medium roller and a second recess in the drive plate, each recess having a star-shaped inner contour into which the star-shaped outer contour of the deformation body fits, in order to create a positive transmission of the rotational movement between the pulling medium roller and the drive plate.

2. A starting device according to claim 1, characterised in that the deformation body comprises a rubber material, a rubber-like plastic material, or a polyurethane with permanently elastic properties, wherein the deformation body has an absorption capacity so as to dampen the rotational movement between the pulling medium roller and the crankshaft.

3. A starting device according to claim 1, characterised in that the deformation body is divided into a cylindrical section which extends in the direction of the axis of rotation, a first end section with the star-shaped outer contour on the side of the pulling medium roller, and a second end section with the star-shaped outer contour on the side of the drive plate, wherein the cylindrical section forms a flexible region between the end sections.

4. A starting device according to claim 1, characterised in that the drive plate is arranged plane-parallel with the pulling medium roller in the connection between the pulling medium roller and the crankshaft, which drive plate is connected to the crankshaft in a rotationally fixed manner.

5. A starting device according to claim 1, characterised in that the drive plate has at least one stop cam, which at maximum twisting comes to bear against a stop geometry formed on the pulling medium roller in order to limit the twisting movement of the drive plate with respect to the pulling medium roller.

6. A starting device according to claim 1, characterised in that an axis element is provided, which extends along the axis of rotation through the drive plate, the deformation body and the pulling medium roller.

7. A starting device according to claim 1, characterised in that the drive plate has two drive pins on the flat surface which lies opposite the star-shaped recess, to which pins a pawl system is connected in order to create a free-running state of the internal combustion engine.

8. A starting device according to claim 1, characterised in that the pulling medium roller and/or the drive plate are fabricated from a plastic material.

9. A starting device according to claim 1, characterised in that a variokinematic connection is provided between the pulling medium roller and the crankshaft, wherein the deformation body introduces variable crankshaft torque into the crankshaft depending on the rotational angle of the crankshaft at a constant starter torque.

10. A starting device according to claim 1, characterised in that the pulling medium roller has an accommodating depression into which the drive plate is inserted, wherein the outer diameter of the drive plate is matched to the inner diameter of the accommodating depression.

11. A starting device according to claim 10, characterised in that the drive plate has a plurality of stop cams which are arranged on the outside on the outer diameter, and the pulling medium roller further has a plurality of stop geometries which are arranged on the inner diameter of the accommodating depression and extend radially inwards in order to interact with the stop cams.

12. A method for fabricating a starting device with a deformation body according to claim 1, characterised in that the deformation body is injected into the star-shaped hollow space formed by the recesses by means of an injection moulding method while the pulling medium roller and the drive plate are joined into each other.

13. A method according to claim 12, characterised in that in the injection moulding method the material of the deformation body is vulcanised on the surfaces at least of the pulling medium roller and/or of the drive plate in order to create by means of the deformation body a permanent connection between the pulling medium roller and the drive plate.

* * * * *